US009734962B2

(12) United States Patent
Lin et al.

(10) Patent No.: US 9,734,962 B2
(45) Date of Patent: Aug. 15, 2017

(54) KEY STRUCTURE AND KEYBOARD HAVING KEY STRUCTURE

(71) Applicant: Chicony Electronics Co., Ltd., New Taipei (TW)

(72) Inventors: Chun-Ting Lin, New Taipei (TW); Chieh-Fan Chuang, New Taipei (TW); Liang-Chun Yeh, New Taipei (TW); Chun-Te Lee, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 14/991,943

(22) Filed: Jan. 9, 2016

(65) Prior Publication Data

US 2017/0125185 A1 May 4, 2017

(30) Foreign Application Priority Data

Oct. 28, 2015 (TW) ..... 104135500 A

(51) Int. Cl.
*H01H 13/70* (2006.01)
*H01H 13/14* (2006.01)
*H01H 13/7065* (2006.01)

(52) U.S. Cl.
CPC ..... *H01H 13/14* (2013.01); *H01H 13/7065* (2013.01); *H01H 2205/002* (2013.01); *H01H 2221/044* (2013.01)

(58) Field of Classification Search
CPC ..... H01H 3/12; H01H 3/122; H01H 3/125; H01H 3/7065; H01H 3/7073; H01H 13/7065; H01H 13/7073; G06F 1/1662
USPC ..... 200/344, 345, 5 A; 361/679.13; 341/22; 400/472, 473, 490, 495
See application file for complete search history.

(56) References Cited

U.S. PATENT DOCUMENTS 5,329,084 A * 7/1994 Watanabe ..... H01H 3/125 200/344
8,207,465 B2 * 6/2012 Maruyama ..... H01H 3/125 200/344
9,312,079 B2 * 4/2016 Chang ..... H01H 3/125
9,508,505 B2 * 11/2016 Hsu ..... H01H 3/125

FOREIGN PATENT DOCUMENTS

TW 378767 U 1/2000
TW M482833 U 7/2014

* cited by examiner

*Primary Examiner* — Vanessa Girardi
(74) *Attorney, Agent, or Firm* — Chun-Ming Shih; HDLS IPR Services

(57) ABSTRACT

A key structure includes a carrying body, a frame body, a keycap and at least two connecting members. The frame body is disposed on the carrying body, and the frame body is disposed with a plurality of sliding grooves. The keycap has a plurality of cap edges and correspondingly covers the top of the frame body, and the keycap is disposed with a plurality of pivoting portions. The at least two connecting members are independent from each other. The at least two connecting members are connected between the keycap and the frame body, corresponding to the two cap edges opposite to each other. Each connecting member includes a pivoting rod and a sliding rod. Each pivoting rod pivots on each pivoting portion. Each sliding rod is slidably limited in each sliding groove, and the pivoting portions are correspondingly located on the outside of the sliding grooves.

18 Claims, 12 Drawing Sheets

KEY STRUCTURE AND KEYBOARD HAVING KEY STRUCTURE

TECHNICAL FIELD

The disclosure relates to a key, more particularly to a key structure with preferred structural strength, smooth pressing movement and reliable pressing contact, and a keyboard having the key structure.

BACKGROUND OF THE INVENTION

Currently the keys on a keyboard generally comprise a substrate, a keycap and a connecting component movably connected between the substrate and the keycap. The connecting component has a space for an elastic member to go through and move while the elastic member elastically supports between the keycap and the substrate. The substrate is disposed with a circuit layer. The circuit layer is disposed with a trigger switch corresponding to the elastic member. When the keycap is pressed by a hand, the connecting component guides the keycap to move downward and makes the elastic member touch the trigger switch, thereby reaching the goal of signal transmission by tapping the keys of the keyboard.

FIG. 11 is a prior art of a Taiwan patent of which the certification number is 378767. As shown in FIG. 11, the document has disclosed an improved structure for the key switch of the computer. From top to bottom, it comprises a keycap, a connecting component of scissor style, a U-shaped stand, an elastic member, a circuit layer and a substrate, thereby forming the key switch accordingly. However, it has following problems: (1) Due to the connecting component of scissor style, the U-shaped stand must be in the U shape (the right side of the U-shaped stand forms an opening) and it cannot be designed in a surrounding frame, which results in insufficient structural strength of the U-shaped stand. There is a deformation when being pressed and this affects the action of the connecting component of scissor style. Thereby, the movement of the key switch being pressed is not smooth and the pressing contact thereof is not reliable; (2) Sine the U-shaped stand is utilized, the front and rear sides thereof respectively form two axis holes which are recessed. As a result, only the connecting component of scissor style can be used here and other types of connecting components are not suitable for this design; (3) The lower end foot on the left side of the connecting component of scissor style rubs the substrate. The connecting component is made of plastics while the substrate is made of metal, so that the issue of abrasion of the connecting component of scissor style arises; (4) The connecting component of scissor style must form the opening for accommodating the elastic member, which results in insufficient structural strength of the connecting component of scissor style which tends to slant when being pressed; (5) For fixing the U-shaped stand and positioning the connecting component of scissor style, the circuit layer and the substrate form many holes which are not ideal for waterproof, dust-proof and circuit layout of the circuit layer.

FIG. 12 is a prior art of a Taiwan patent of which the certification number is M482833. As seen in FIG. 12, the document has disclosed a key structure in which the top side of the metal bending rod pivots on the keycap while the bottom side of the metal bending rod is sildably connected on the sliding groove of the boost plate, thereby forming the connecting component connected between the keycap and the bottom plate. Additionally, the elastic member is disposed between the keycap and the bottom plate to form the key structure. Nonetheless, it has following problems: (1) The metal bending rod is merely a metal wire of which the structural strength is not enough, and it must go through bending molding which is not easy to manufacture and is costly. Also, the precision of manufacturing is hard to control and this therefore affects the yield rate negatively; (2) In the matching between the metal bending rod and the bottom plate, the former is made of metal while the latter is made of plastics so the abrasion of the sliding groove of plastics emerges. In the long run, this abrasion causes the loose connection in terms of the sliding connection. Furthermore, if the latter is made of metal, the metal slides on the metal results in abrasion which affects the durability of the products and harsh noises which bothers the users when operating it; (3) For the slim design of the keyboard, the size of the metal bending rod has to be reduced but this makes it even harder to manufacture; (4) Since the metal bending rod serves as the connecting component between the keycap and the bottom plate, it leads to unstable store, size not easy to control and insufficient precision. Thereby, the movement of the key being pressed is not smooth and the pressing contact thereof is not reliable, and all the actions are done on the bottom plate. Moreover, many unnecessary holes are formed which are not ideal for waterproof, dust-proof and circuit layout of the circuit layer.

Consequently, it is important to provide an improved design for solving the aforementioned problems.

SUMMARY OF THE INVENTION

The goal of the disclosure is to provide a key structure which makes the frame body and the connecting member have preferred structural strength and make all actions focus on the frame body. This may lead to smooth movement when being pressed and reliable pressing contact.

To reach the goal, the disclosure provides a key structure comprising a carrying body, a frame body, a keycap and at least two connecting members. The frame body is disposed on the carrying body, wherein the frame body is disposed with a plurality of sliding grooves. The keycap has a plurality of cap edges and correspondingly covers the top of the frame body, wherein the keycap is disposed with a plurality of pivoting portion. The at least two connecting members are independent of each other. The at least two connecting members are connected between the keycap and the frame body, corresponding to the two cap edges opposite to each other. Each connecting member comprises a pivoting rod and a sliding rod. Each pivoting rod pivots on each pivoting portion. Each sliding rod is slidably limited in each sliding groove, and the pivoting portions are correspondingly located on the outside of the sliding grooves.

The disclosure further provides a keyboard comprising a plurality of keys. At least one of the keys is the key structure mentioned above.

Compared to prior art, the disclosure may produce the following effects: because of the frame body and the multiple connecting members independent of each other and without any hole, the disclosure has preferred structural strength. In addition, the actions focus on the frame body so when being pressed, the pressing movement is smooth and the pressing contact is reliable.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Figure 1:
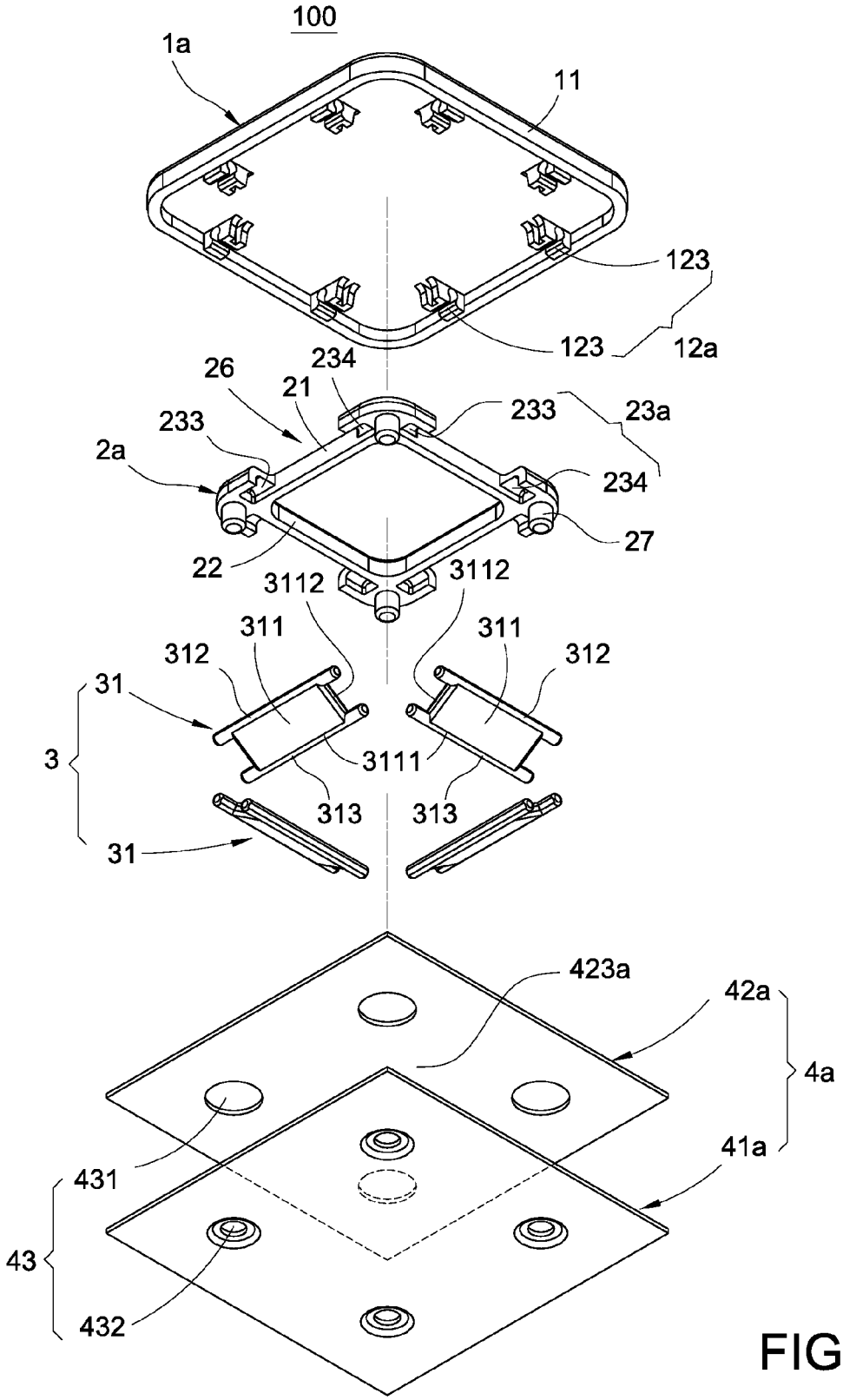
FIG. 1 is an exploded view of the first embodiment of the disclosure (omitting the elastic member)

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 4:
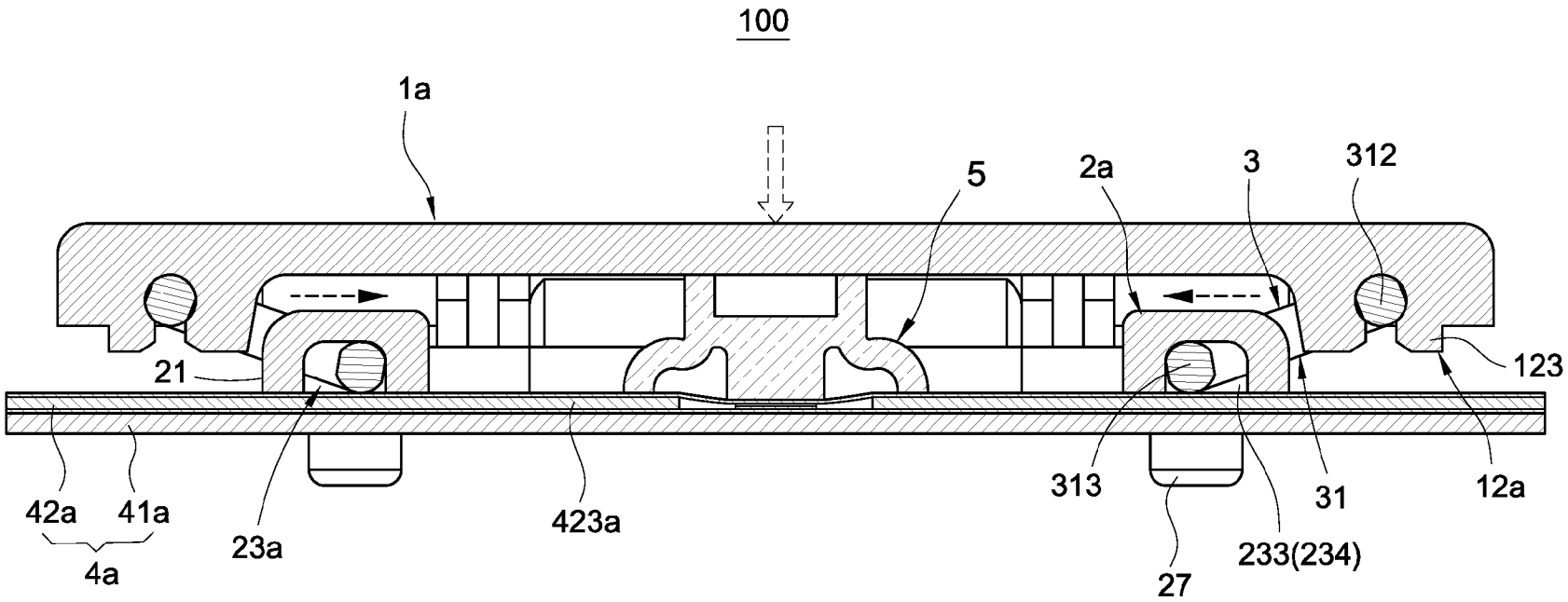
FIG. 4 is a sectional view of FIG. 3 after action.
Figure 5:
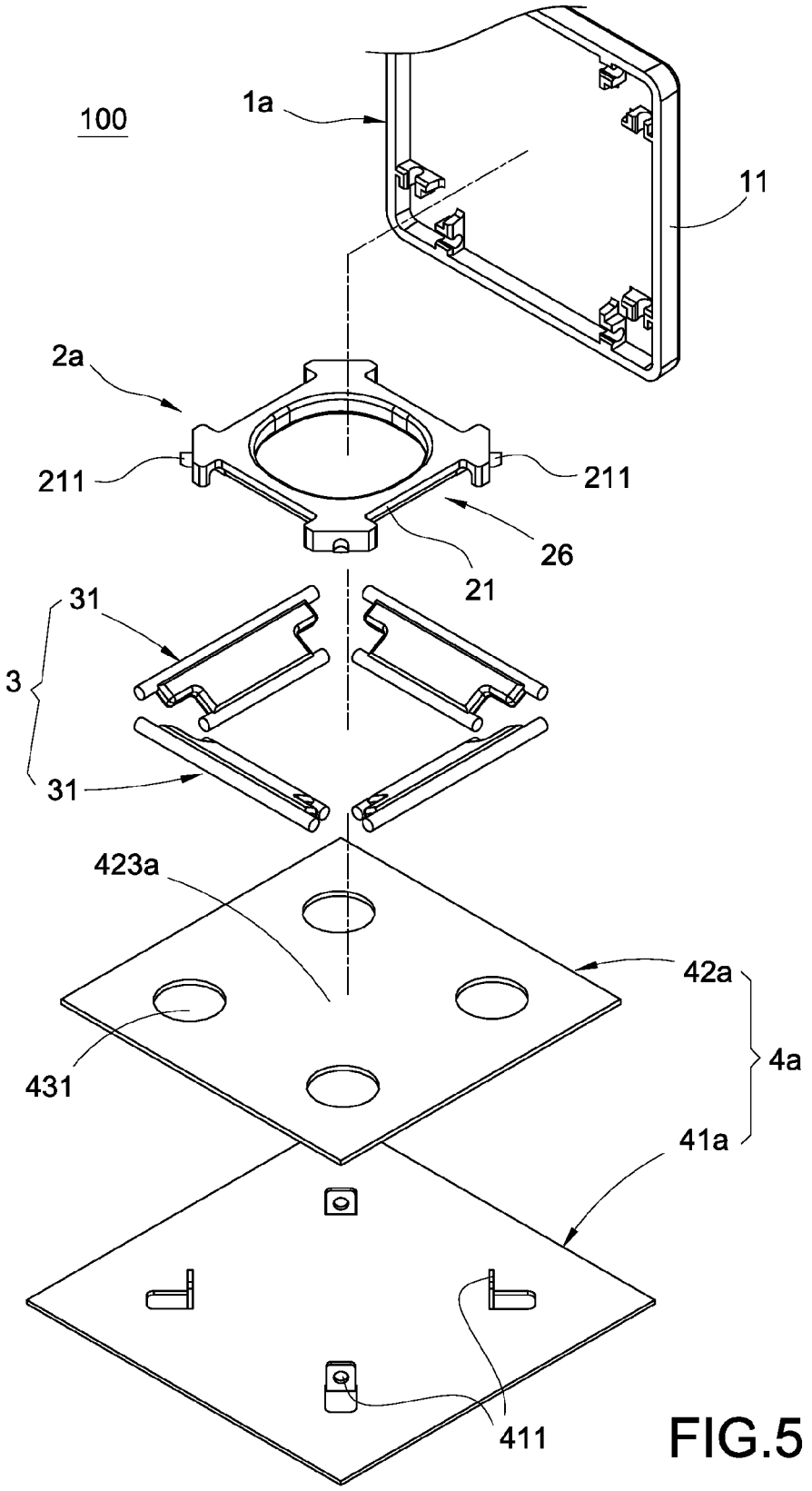
FIG. 5 is an exploded view of the second embodiment of the disclosure (omitting the elastic member)
Figure 6:
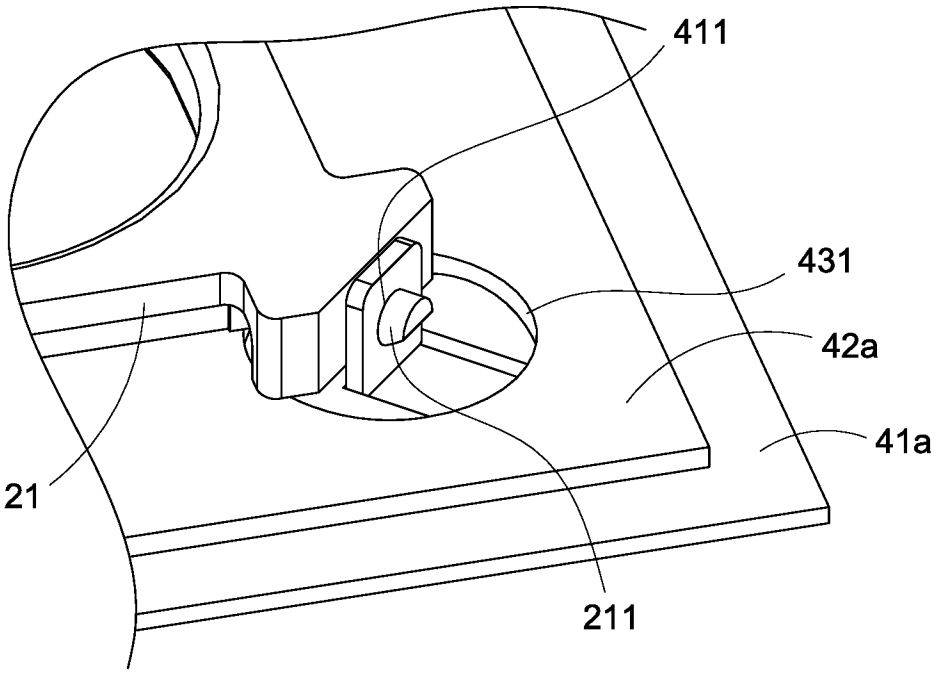
FIG. 6 is a partial perspective view of FIG. 5 after assembly.
Figure 7:
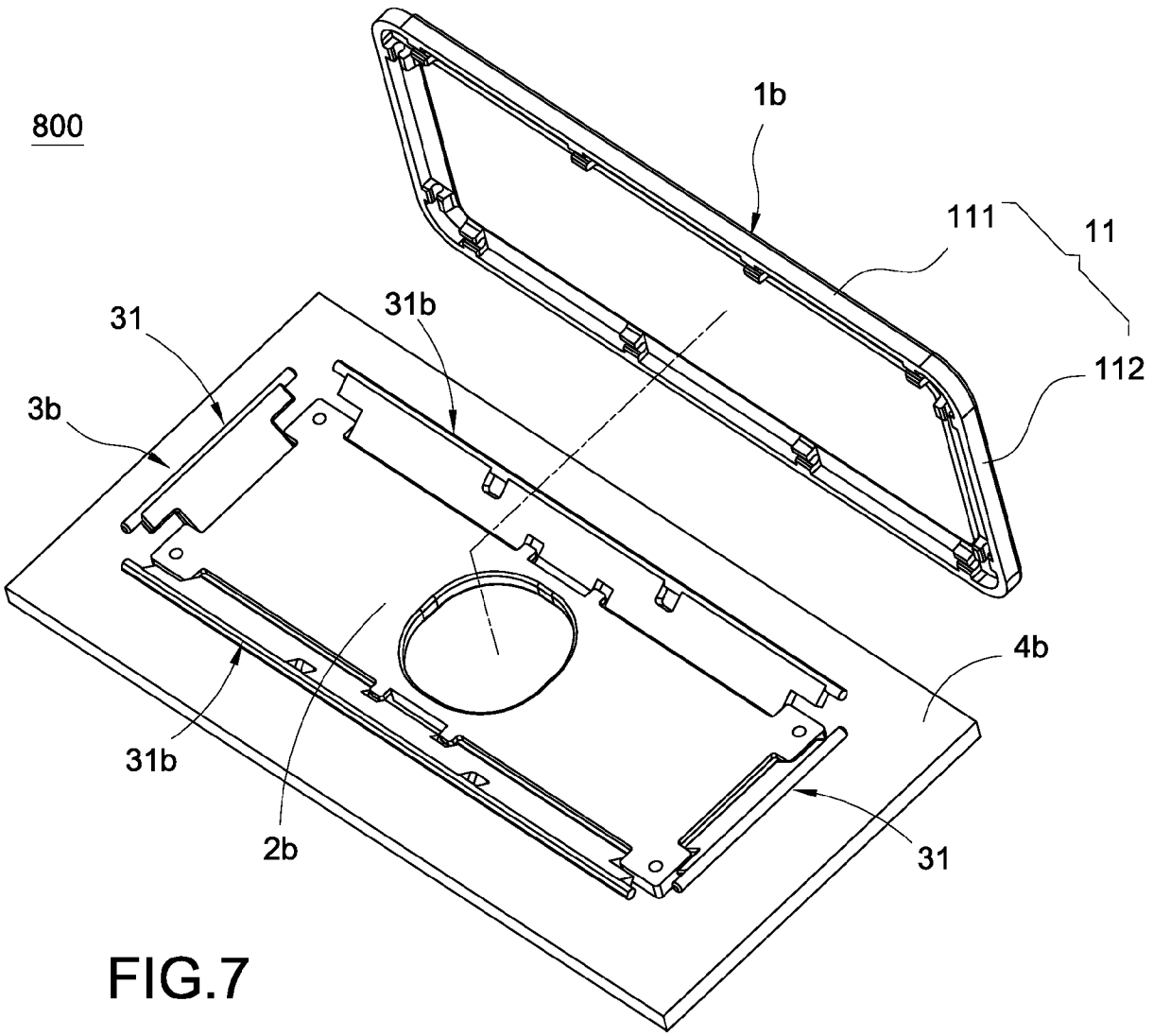
FIG. 7 is a partial exploded view of the third embodiment of the disclosure (omitting the elastic member)
Figure 8:
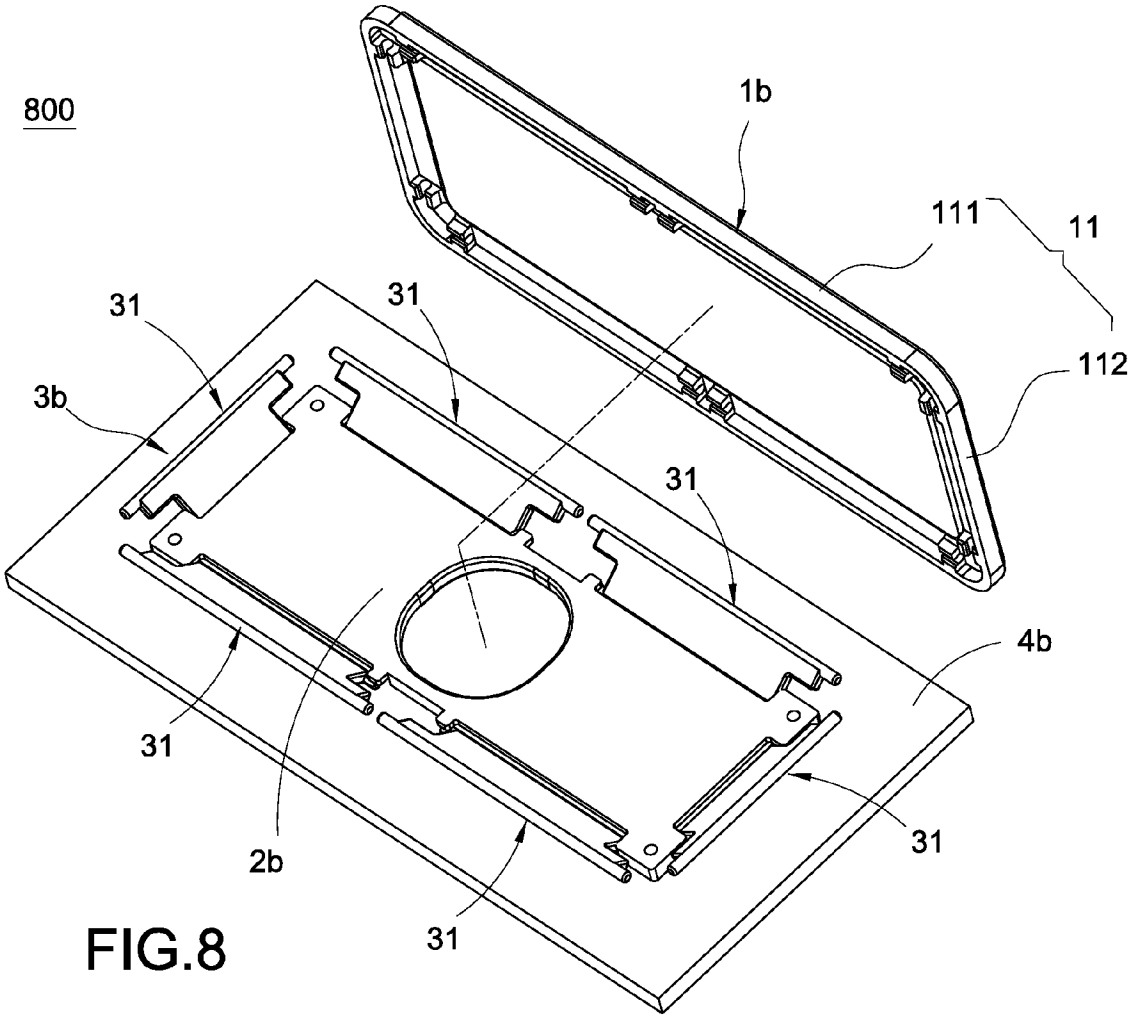
FIG. 8 is a partial exploded view of the fourth embodiment of the disclosure (omitting the elastic member)
Figure 9:
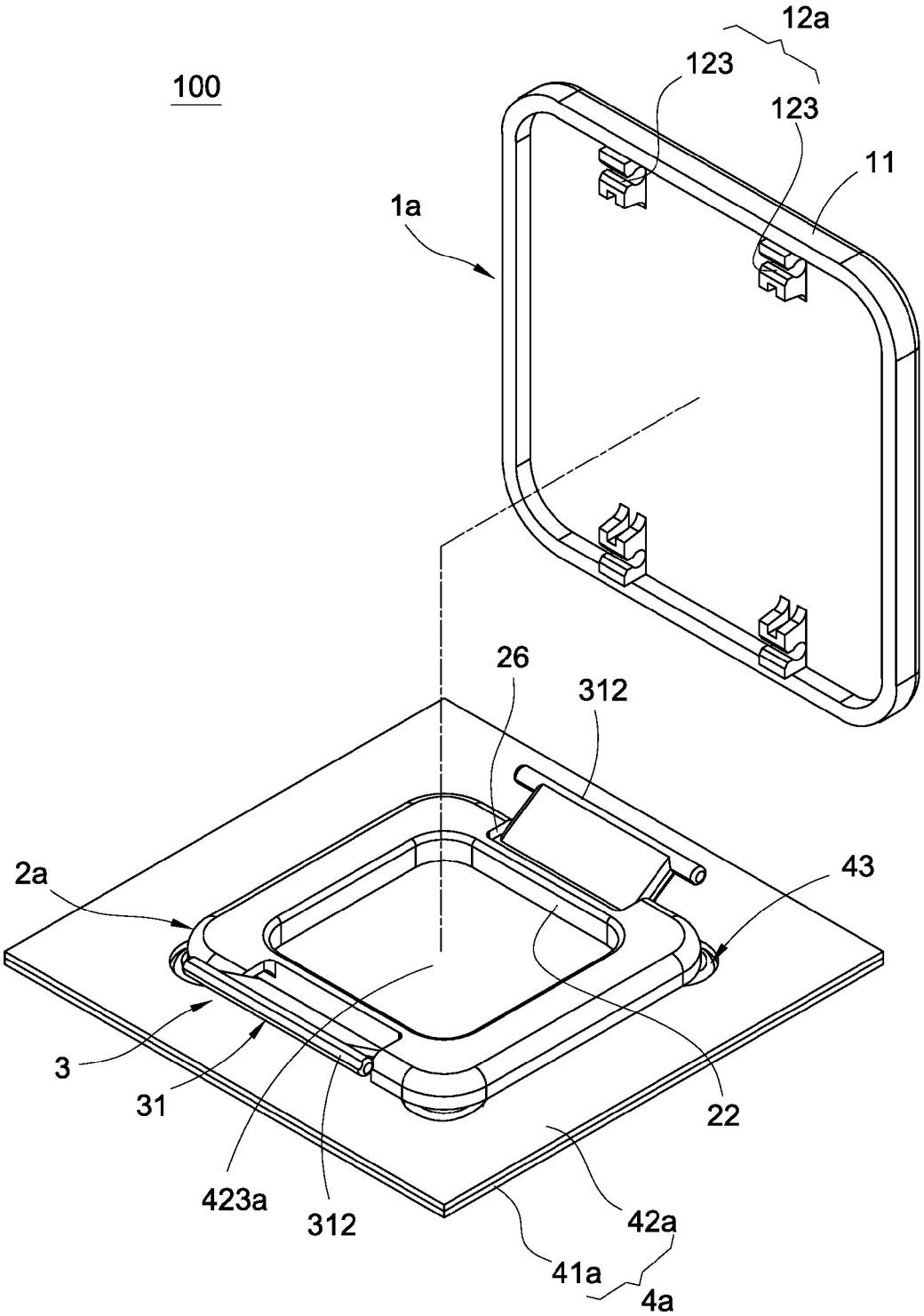
FIG. 9 is an exploded view of the fifth embodiment of the disclosure (omitting the elastic member)
Figure 10:
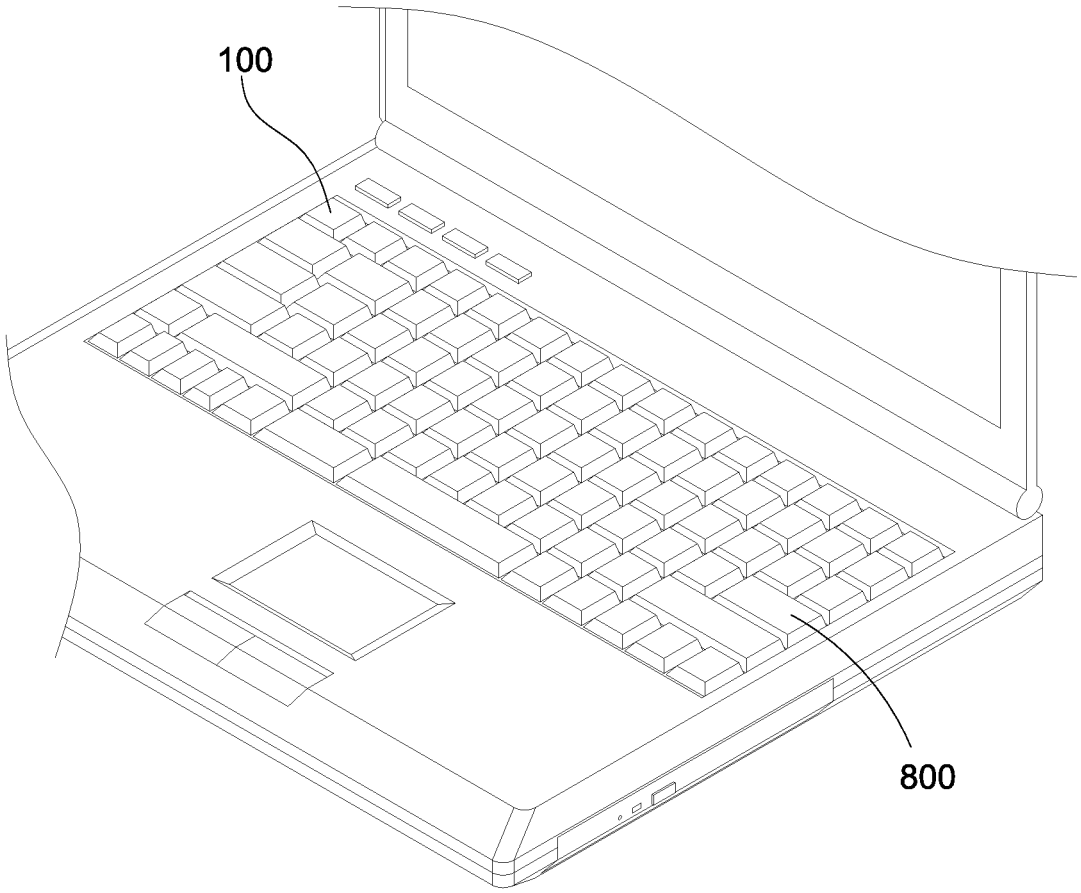
FIG. 10 is a perspective view of the appearance of the disclosure applying on the keyboard.
Figure 11:
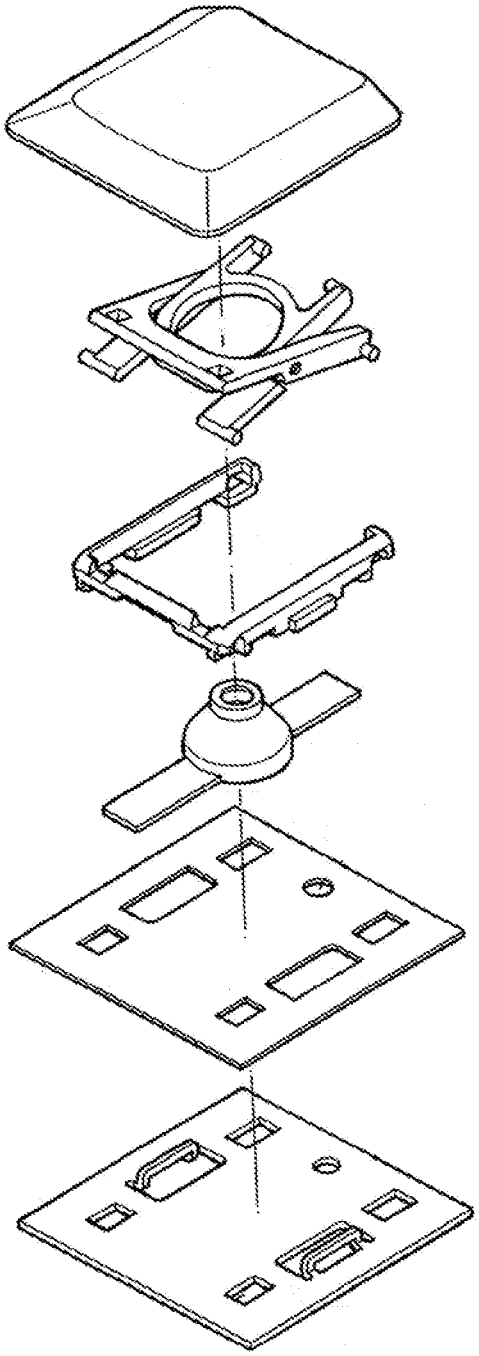
FIG.11 (Related Art)
FIG. 11 is a prior art of a Taiwan patent of which the certification number is 378767.
Figure 12:
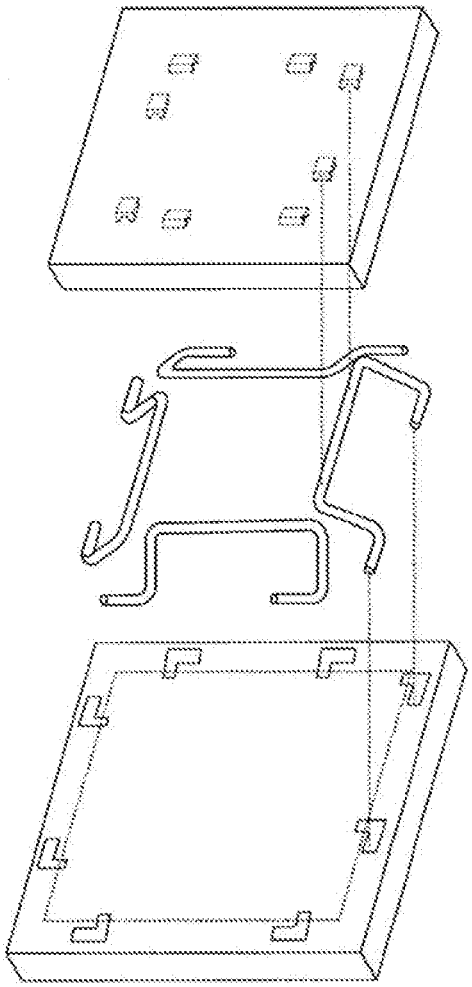
FIG.12 (Related Art)
FIG. 12 is a prior art of a Taiwan patent of which the certification number is M482833.

The disclosure provides a key structure and a keyboard having the key structure. FIG. 1 to FIG. 4 show the first embodiment of the disclosure. FIG. 5 and FIG. 6 show the second embodiment of the disclosure. FIG. 7 shows the third embodiment of the disclosure. FIG. 8 shows the fourth embodiment of the disclosure. FIG. 9 shows the fifth embodiment of the disclosure. FIG. 10 illustrates the disclosure applying on the keyboard. Specifically, the keyboard may be a normal independent keyboard or a keyboard arranged on a laptop, for example, and the disclosure is not limited thereto. The keyboard comprises a plurality of keys and at least one of these keys is the key structure illustrated below.

Figure 2:
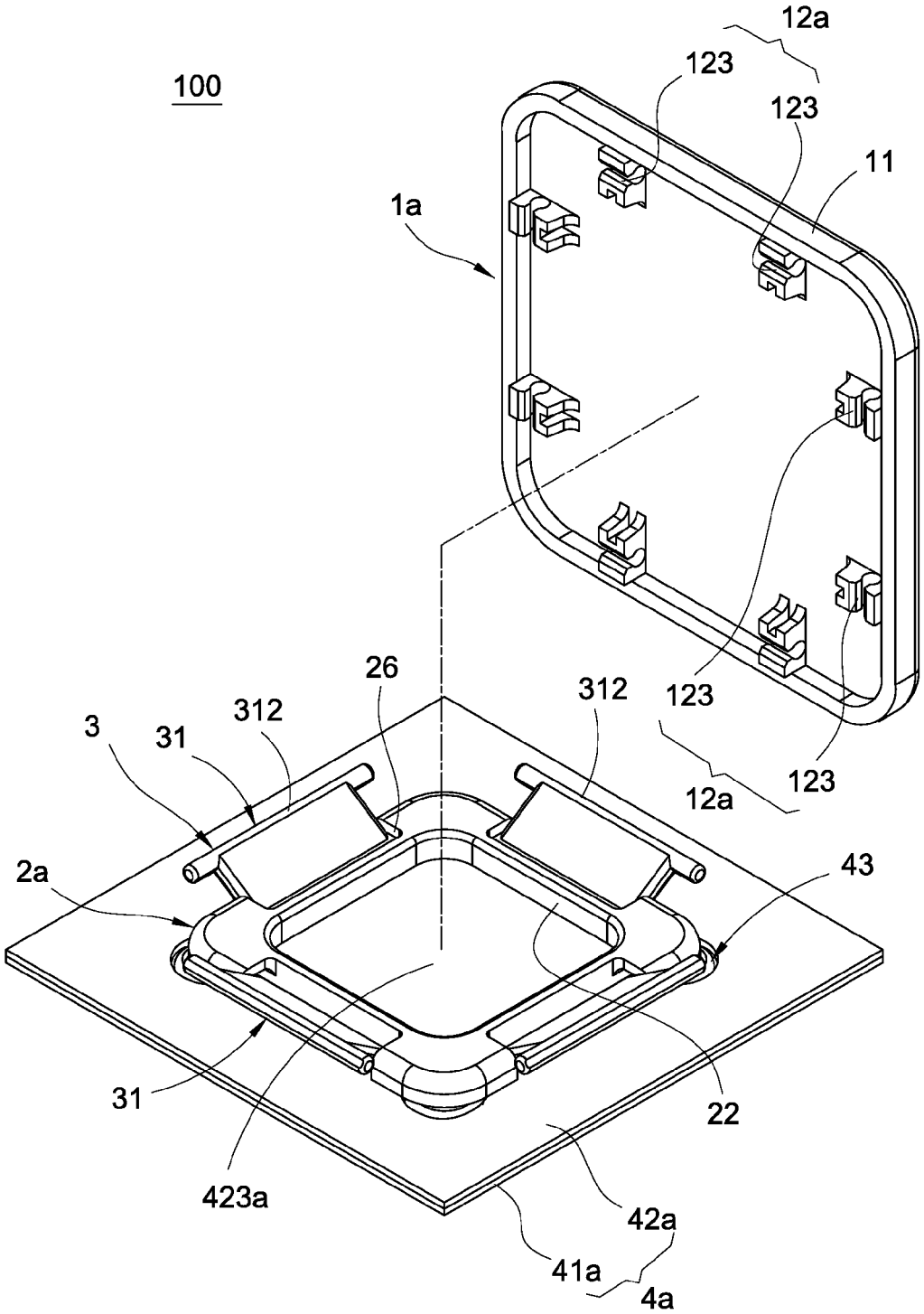
FIG. 2 is a perspective view of the partial assembly of the first embodiment of the disclosure according to FIG. 1.
Figure 3:
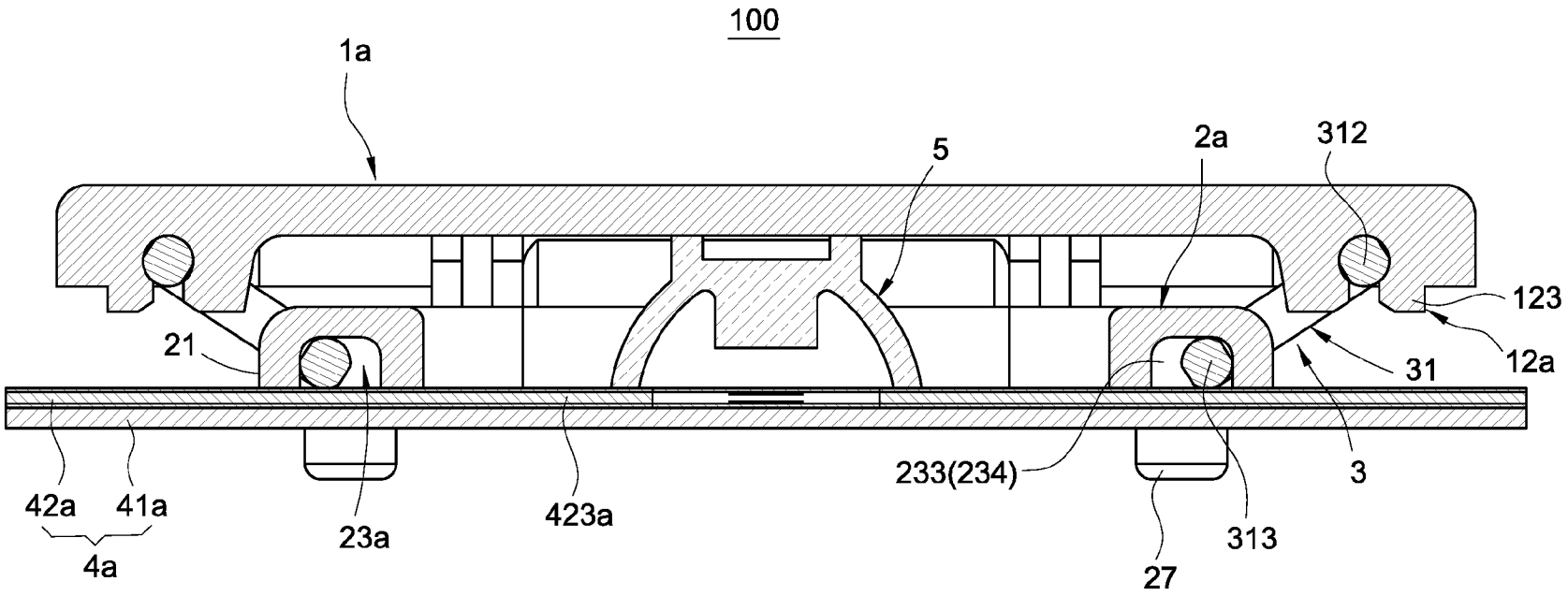
FIG. 3 is a sectional view of the first embodiment of the disclosure after assembly and before action (including the elastic member)

The key structure 100 of the first embodiment of the disclosure, as shown in FIG. 1, FIG. 2 and FIG. 3, comprises a keycap 1*a*, a frame body 2*a*, a connecting assembly 3, a carrying body 4*a* and an elastic member 5. As shown in FIG. 3, the size of the frame 2*a* is smaller than the size of the keycap 1*a* so that the keycap 1*a* correspondingly covers the top of the frame body 2*a*.

The carrying body 4*a* is configured for carrying the keycap 1*a*, the frame body 2*a*, the connecting assembly 3 and the elastic member 5. The carrying body 4*a* comprises a bottom plate 41*a* and a film circuit board 42*a* stacked up on the bottom plate 41*a*. The way of the film circuit board 42*a* stacked up on the bottom plate 41*a* is not intended to limit the disclosure. The film circuit board 42*a* of this embodiment is stacked up on the bottom plate 41*a*, for example. Furthermore, the carrying body 4*a*, if required, may be arranged with a plurality of keycaps 1*a*, a plurality of frame bodies 2*a*, a plurality of connecting assemblies 3 and a plurality of elastic members 5, for forming a keyboard or a set of keys. In this embodiment, however, only a single key is illustrated as an example, but the disclosure is not limited thereto.

The keycap 1*a* is for a user to press and may be a keycap of standard keys (e.g., English alphabet or Arabic numbers), or may be keycap of the multiple key (e.g., Enter key, Backspace key, Shift key or spacebar), and the disclosure is not limited thereto. In this embodiment, the keycap of standard keys is used as an example. The keycap 1*a* has a plurality of cap edges 11 to form the polygonal keycap 1*a*. In this embodiment, a rectangular keycap la formed by four cap edges 11 is used as an example. The bottom surface of the keycap 1*a* is disposed one pivoting portion 12*a* for each of the court cap edges 11. The disclosure is not limited to the specific structure of the pivoting portion 12. This embodiment includes two pivoting bodies 123 spaced apart from each other, for illustration, in which each pivoting portion 12*a* is preferably separated from each other.

The frame body 2*a* is, by definition, an object with a surrounding frame shape. It comprises four frame edges 21 corresponding to the keycap 1*a* and therefore is in a rectangular shape. The frame body 2*a* further has four inner edges 22 corresponding to the four frame edges 21. The frame body 2*a* is disposed on the carrying body 4*a*, wherein the disclosure is not limited to the frame body 2*a* being disposed on the bottom plate 41*a* of the carrying body 4*a* or being disposed on the film circuit board 42*a*, as long as the frame body 2*a* and the carrying body 4*a* are stably connected. In this embodiment, the frame body 2*a* is disposed on the bottom plate 41*a* and the frame body 2*a* and the bottom plate 41*a* are connected via welding or mounting connection. The film circuit board 42*a*, on the other hand, is disposed between the frame body 2*a* and the bottom plate 41*a*. For instance, the frame body 2*a* and the bottom plate 41*a* may be connected together by a welded structure or a mounting structure. It should be noted that, the number, position and size of the aforementioned welded structure or mounting structure may be adjusted if required. Hence, the film circuit board 42*a* only needs to partially form holes 431 corresponding to the aforementioned welded structure or mounting structure. The middle section of the film circuit board 42*a*, in contrast, does not require to form any hole. Hence, smaller and less amount of welded structures and mounting structures may effectively reduce the number and the size of the holes, thereby improving the performance of waterproof and dust-proof. Moreover, it increases the size of circuit layout of the film circuit board 42*a*. The wording of "partially form holes" means that the holes 431 just need to be slightly larger than the welded structure or mounting structure.

The frame body 2*a* respectively forms an opening 26 corresponding to each frame edge 21. Each frame edge 21 respectively forms a sliding groove 23*a*. Each sliding groove 23*a* comprises a first sliding groove 233 and a second sliding groove 234. The first sliding groove 233 and the second sliding groove 234 are respectively formed on two ends of the position of the frame body 2*a* corresponding to the opening 26.

Except for the four openings 26 and the four sliding grooves 23*a*, the other part of the bottom plate of the frame body 2*a* may form a plurality of fixing columns 27. The film circuit board 42*a* form a plurality of holes 431 corresponding to each fixing column 27, thereby enabling each fixing column 27 of the frame body 2*a* to go through the hole 431 and be disposed on the bottom plate 41, in which the preferable connection manner is by welding or mounting connection, but it is not limited thereto. Additionally, the part of the film circuit board 42*a* surrounded by each hole 431 forms the middle section 423*a* without any hole. Specifically, as shown in FIG. 1, the part surrounded by each inner edge 22 of the film circuit board 42*a* corresponding to the frame body 2*a* is defined as the middle section 423*a*. In this embodiment, the carrying body 4*a* forms a plurality of hole bodies 43 which comprises the fixing hole 432 and the hole 431. The hole 431 is formed on the film circuit board 42*a* while the fixing hole 432 is formed on the bottom plate 41*a*, thereby enabling the fixing column 27 of the frame body 2*a* to be fixed to the fixing hole 432 of the bottom plate 41*a* via the hole 431.

The connecting assembly 3 comprises at least two connecting members 31 opposite and independent of each other. Each connecting member 31 is a sheet structure and is connected, corresponding to each cap edge 11, between the keycap 1*a* and the frame body 2*a*. Specifically, each connecting member 31 extends inwardly and downwardly from the keycap 1*a* to each frame edge 21 of the frame body 2*a*, and the cap edge 11 of the keycap 1*a* correspondingly surrounds the outside of the sliding groove 23*a* of the frame body 2*a* (as shown in FIG. 3 and FIG. 4). Therefore, the frame body 2*a* may be hidden inside the whole key structure 100. The connecting assembly 3 of this embodiment comprises four connecting member 31. The connecting member 31 comprises a plate sheet 311, a pivoting rod 312 and a sliding rod 313. The plate sheet 311 is preferably in a rectangular shape and has two connecting edges 3111 opposite to each other and two lateral edges 3112 opposite to each other.

The rod parts of the pivoting rod 312 and the sliding rod 313 are disposed on the two connecting edges 3111 of the connecting member 31, respectively. The two ends of the pivoting rod 312 respectively protrude from the two lateral edges 3112 of the connecting member 31, thereby pivoting on the two pivoting bodies 123 of the pivoting portion 12*a*. The two ends of the sliding rod 313 also protrude from the two lateral edges 3112 of the connecting member 31, thereby being limited in the first sliding groove 233 and the second sliding groove 3112 in a slidable manner, while the sliding rod 3113 slides on the film circuit board 42*a*. It should be noted that longer pivoting rod 312 and sliding rod 313 are beneficial to the power transmission of the pressing force of the keycap 1*a*. In this embodiment, the sliding rod 313 is limited in the sliding groove 23*a* and slides on the film circuit board 42*a*. That is, the action area of the film circuit board 42*a* corresponding to the sliding rod 313 does not form any hole and is suitable for circuit layout. This makes the circuit layout of the film circuit board 42*a* easier. Furthermore, the plate sheet 311 of the disclosure is a complete sheet so its structural strength is sufficient and the overall structure of the connecting member 31 is simple. This is ideal for plastic molding and may achieve preferred yield rate and preferred precision, which reduces manufacturing time and costs dramatically. Compared to prior art, this is more suitable for keyboard structure of slim design. Also, the connecting member 31 and the frame body 2*a* may be made of nonmetal materials so the sliding rod 313 of the connecting member 31 sliding on the sliding groove 23*a* of the frame body 2*a* would not cause the problem of prior art regarding the metal abrasion. This improves the durability of the key structure and avoids the noise issue of the key structure 100 in action. In one specific embodiment of the disclosure, the overall structure of the connecting member 31 is made by injection molding.

Each connecting member 31 is aslant arranged between the keycap 1*a* and the frame body 2*a*. In this embodiment, the gap between each connecting member 31 is wider at the top and gradually narrower till the bottom, as an example. As shown in FIG. 1 and FIG. 2, one ends of any adjacent two sliding rods 313 are kept close and maintain a gap (namely kept as close as possible without touching or interfering), while the other ends of any adjacent two pivoting rods are away from each other. The pivoting portion 12*a* of the keycap 1*a* is arranged correspondingly to the pivoting rod 312. Specifically, as seen in FIG. 3 and FIG. 4, the pivoting portion 12*a* connected by every connecting member 31 and the sliding groove 23*a* are staggered, and the sliding rod 313 of each connecting member 31 slides correspondingly to each sliding groove 23*a* and generates a sliding direction (referring to FIG. 4, four arrows including a left arrow and a right arrow, along with front and back arrows not shown in the figure, represent four sliding directions). After pressing, each connecting member 31 inclines along each sliding direction.

For corresponding to the slant arrangement of the connecting assembly 3 of the disclosure (connecting members 31 with wider gap at the top and narrower gap at the bottom in between), the first sliding groove 233 and the second sliding groove 234 of the sliding groove 23*a* of the frame body 2*a* are spaced apart from each other. Also, the first sliding groove 233 and the second sliding groove 234 of each of any adjacent two sliding grooves 23*a* are arranged next to each other.

The elastic member 5 is movably disposed between each connecting member 31 of the connecting assembly 3 and is between and elastically supports the bottom surface of the keycap 1*a* and the film circuit board 42*a*. This provides a return force for the keycap 1*a* being pressed and return it to the original position. In this embodiment, one end of the elastic member 5 supports the middle section 423*a* of the film circuit board 42*a*.

As shown in FIG. 1, FIG. 3 and FIG. 4, when a hand is pressing the keycap 1*a*, the keycap 1*a* drives the connecting assembly 3 to move towards the bottom plate 41*a*, thereby making the plate sheet 311 of each connecting member 31 move along the aforementioned sliding direction. In addition, the pivoting rod 312 of each connecting member 31 rotates relative to each pivoting portion 12*a*, while the sliding rod 313 of each connecting member 31 slides in each sliding groove 23*a*, from the frame edge 21 of the frame body 2*a* to the inner edge 22. The sliding rod 313 slides directly on the film circuit board 42*a*. At this point, the keycap la moving downward relative to the bottom plate 41*a* forces the elastic member 5 to move downward accordingly and touch the film circuit board 42*a* for conduction, thereby outputting signal.

The pivoting rod 312 of each connecting member 31 is a complete rod structure. Hence, when the finger presses any slant position of the keycap 1*a*, the pivoting rod 312 of the complete rod structure utilizes the pressing force of the hand to transfer the force from one end of the pivoting rod 312 to the other end (in a linear transmission); Via the keycap 1*a* as an medium, the two ends of the pivoting rod 312 can also transfer the pressing force of the hand to the other adjacent two pivoting rods 312 (in a U-shaped transmission). Lastly, the other two pivoting rods 312, using the keycap 1*a* as an medium, transfer it to the fourth adjacent pivoting rod 312 (in a rectangular transmission), thereby reaching the goal of evenly transferring the pressing force.

When the pressing force from the hand is released, the normal state without being pressed is elastically returned by the elastic member 5. The keycap 1*a* is raised to its original position and thus drives the connecting assembly 3 to move.

This makes the pivoting rod 312 of the connecting member 31 reversely rotates relative to the pivoting portion 12*a* and makes the sliding rod 313 slides at an opposite direction (a direction from the inner edge 22 to the frame edge 21). Thus, a one-time pressing process is completed.

Additionally, the middle section 423 does not require to form any hole so the key structure 100 is of preferred performance regarding waterproof, dust-proof and circuit layout of the film circuit board 42*a*. In this embodiment, only the film circuit board 42*a* forms partial holes 431 for fixing columns 27 to go through, as an example.

Also noteworthy is that the frame body 2*a* and/or each connecting member 31 are integrally formed, preferably by injection molding. Therefore, the advantages include stable structure, size easy to control and good precision. When being pressed, it is smooth and the pressing contact is reliable. The connecting member 31 may integrally form the pivoting rod 312 and the sliding rod in the round rod shape and this is beneficial to pivoting, lower abrasion and preferred fitting. The connecting member 31 may further be made of resin with the lubricating effect (preferably nylon) so it can be more ideal for sliding.

FIG. 5 and FIG. 6 show a key structure 100 of the second embodiment of the disclosure. The second embodiment is similar to the first embodiment, but the fixing method between the frame body 2*a* and the bottom plate 41*a* is by mounting structure. Consequently, the frame body 2*a* does not require to have the fixing column 27 mentioned before and this is illustrated below.

The mounting structure comprises a plurality of mounting members 211 disposed on the frame body 2*a* and a plurality of corresponding mounting members 411 disposed on the bottom plate 41*a*. Each mounting member 211 and each corresponding mounting member 411 are correspondingly mounted together. Each mounting member 211 is preferably disposed on the frame edge 21 of the frame body 2*a* while each corresponding counting member 411 is exposed corresponding to the position of each hole 431. Accordingly, the frame body 2*a* may utilize each mounting member 211 thereof correspondingly mounted on the corresponding mounting members 411 of the bottom plate 41*a* to be stably fixed to the bottom plate 41*a*.

FIG. 7 shows a key structure 800 of the third embodiment of the disclosure. The third embodiment is similar to the first or second embodiment, but the keycap 1*b* of the third embodiment is a keycap of a multiple key, which is illustrated below.

The cap edge 11 of the keycap 1*b* comprises two long cap edges 111 and the two short cap edges 112 connected between two ends of each long cap edge 111. The shape of the frame body 2*b* corresponds to the keycap 1*b* so the frame edge 21 also has long and short edges.

In the connecting member of the connecting assembly 3*b*, the connecting member 31 correspondingly connected to the short edge 112 is identical to the connecting member in the first or second embodiment. However, the connecting member 31*b* correspondingly connected to the long edge 111 is changed into a long connecting member 31*b* with corresponding length. The carrying body 4*b* still comprises a bottom plate and a film circuit board stacked up on the bottom plate.

FIG. 8 shows a key structure 800 of the fourth embodiment of the disclosure. The fourth embodiment is similar to the third embodiment, but the connecting member connected to the long cap edge 111 in the fourth embodiment is different, which is illustrated below.

In the connecting members, it is still using single connecting member 31 to be correspondingly connected to the short cap edge 112. For the long cap edge 111, however, at least two connecting members arranged in parallel are correspondingly connected to the long cap edge 111.

FIG. 9 shows a key structure 100 of the fifth embodiment of the disclosure. The fifth embodiment is similar to the first or second embodiment, but the fifth embodiment only has two connecting members 31 opposite to each other, and the fixing method between the frame body 2*a* and the carrying body 41 is done via the welded structure. That is, the frame body 2*a* is welded to be connected to the corresponding position of the carrying body 4*a* and this ensures a stable connection between the frame body 2*a* and the carrying body 4*a*. In one embodiment of the disclosure which is not shown in the figures, each fixing column 27 may be melted to be connected to the corresponding position of the bottom plate via each hole 431 of the film circuit board 42*a* (referring to FIG. 1) such that a stable connection between the frame body 2*a* and the carrying body 41 is ensured.

FIG. 10 is a schematic view showing the appearance the key structure 100 and/or 800 of the disclosure applying on a keyboard. As seen in the figure, the keyboard is arranged with at least one key structure 100 of the standard key type and at least one key structure 800 of the multiple key type.

Except for the aforementioned effects, the disclosure, compared to prior art, further has the following effects:

Since the frame body 2*a*(2*b*) is in a surrounding frame shape and multiple connecting members independent of each other and without the requirement to form holes for the elastic member 5, the overall design has preferred structural strength. In addition, all actions focus on the frame body 2*a*(2*b*) so the movement of pressing is smooth and the pressing contact is reliable when being pressed. Each connecting member 31(31*b*) corresponds to the arrangement of each cap edge 11 of the keycap 1*a*(1*b*) so they are not staggered, which enables each connecting member 31(31*b*) to not form holes for avoiding elastic member 5.

The connecting member 31(31*b*) is a sheet structure (especially plate 311 which is a complete sheet) so that it has preferred structural strength and preferred supporting strength. When being pressed, the relative position between the pivoting rod 312 and the sliding rod 313 does not slant.

Since the connecting member 31(31*b*) has preferred structural strength and the overall structure of the connecting member 31(31*b*) is simple and is good for plastic molding, the yield rate and the precision are improved. Also, the manufacturing time and costs are significantly reduced, which meets the manufacturing requirement of the keyboard structure of slim design.

The frame body 2*a*(2*b*) and/or each connecting member 31(31*b*) are integrally formed (preferably by injection molding) so the structure is stable, the size is easy to control and is precise. Thereby, the movement of pressing is smooth and the pressing contact is reliable when being pressed. The connecting member 31(31*b*) may integrally form the pivoting rod 312 and the sliding rod 313 in round rod shapes. This is good for pivoting and is of lower abrasion and preferred fitting.

Since the frame body 2*a*(2*b*) and the connecting member 31(31*b*) are made of nonmetal materials, the sliding rod 313 sliding on the sliding groove 23 does not lead to metal abrasion. This effectively improves the durability of the key structure 100(800) and avoids noise during the action of the key structure 100(800).

The film circuit board 42*a* considerably reduce the number of its holes, or even does not have any hole (e.g., reducing/shirking the number/size of the welded structure or the mounting structure), so it has preferred waterproof, dust-proof performances and is ideal for the circuit layout of the film circuit board 42*a*. This makes the circuit layout of the film circuit board 42*a* easier.

The connecting member 31(31*b*) is arranged correspondingly to each cap edge 11 of the keycap 1*a*(1*b*) and the pivoting rod 312 (or the sliding rod 313), as a complete rod, is connected between the keycap 1*a*(1*b*) and the frame body 2*a*(2*b*). This improves the stability of the keycap 1*a*(1*b*) during the pressing process and the pressing force from the human hand may be transferred evenly which reduces the possibility of missing reaction when the pressing position of the hand slants.

This special design of the structure can be applied not only on the standard key but also the multiple key. When it is used on the multiple key, the stability of the pressing process is even more noticeable.

What is claimed is:

1. A key structure, comprising:

a carrying body;

a frame body disposed on the carrying body, wherein the frame body is disposed with a plurality of sliding grooves;

a keycap having a plurality of cap edges and correspondingly covering the top of the frame body, wherein the keycap is disposed with a plurality of pivoting portions; and at least two connecting members independent of each other, wherein the at least two connecting members are connected between the keycap and the frame body, corresponding to two of the cap edges opposite to each other, each connecting member comprises a pivoting rod and a sliding rod, each pivoting rod pivots on one of the pivoting portions, each sliding rod is slidably limited in one of the sliding grooves, and the pivoting portions are correspondingly located on the outside of the sliding grooves.

2. The key structure according to claim 1, wherein the connecting member is a sheet structure and comprises a sheet, the sheet has two connecting edges opposite to each other and two lateral edges opposite to each other, rod bodies of the pivoting rod and the sliding rod are respectively connected to the two connecting edges of the connecting member, two ends of the pivoting rod protrude from the two lateral edges respectively and pivot on the pivoting portion, two ends of the sliding rod protrude from the two lateral edges respectively and are located inside the sliding groove.

3. The key structure according to claim 1, further comprising an elastic member disposed between the connecting member and elastically supporting between the keycap and the carrying body.

4. The key structure according to claim 1, wherein the carrying body comprises a bottom plate and a film circuit board disposed on the bottom plate, the frame body is disposed on the film circuit board, and each sliding rod slides on the film circuit board.

5. The key structure according to claim 1, wherein the pivoting portion connected by each connecting member and the sliding groove are staggered, and the sliding rod of each connecting member slides correspondingly to each sliding groove and respectively generates a sliding direction, each connecting member slants based on each sliding direction.

6. The key structure according to claim 1, wherein the keycap is the keycap of a multiple key, each cap edge of the keycap comprises two long cap edges and two short cap edges connected between the two long cap edges, each connecting member corresponding to the connection of each long cap edge is a long connecting member having a corresponding length.

7. The key structure according to claim 1, wherein the frame body or each connecting member is integrally formed.

8. The key structure according to claim 7, wherein the sliding rod or the pivoting rod of each connecting member is a round rod.

9. The key structure according to claim 1, wherein the number of the connecting members is four, each connecting member, corresponding to each cap edge, is connected between the keycap and the frame body, and the pivoting portions correspondingly surround the outside of the sliding grooves.

10. The key structure according to claim 9, wherein the keycap is the keycap of the multiple key, each cap edge of the keycap comprises two long cap edges and two short cap edges connected between the two long cap edges, the single connecting member is used in the connection corresponding to the short cap edge while at least two of the connecting members in a parallel arrangement are used in the connection corresponding to the long cap edge.

11. The key structure according to claim 1, wherein the carrying body comprises a bottom plate and a film circuit board disposed on the bottom plate, the film circuit board forms a plurality of holes, the frame body is connected to the bottom plate via each hole.

12. The key structure according to claim 11, wherein the frame body is in welded connection with the corresponding position of the bottom plate via each hole.

13. The key structure according to claim 11, wherein the frame body is disposed with a plurality of mounting members, the bottom plate is disposed with a plurality of corresponding mounting members corresponding to and fitting the mounting members, each corresponding mounting member is exposed, corresponding to the position of each hole.

14. The key structure according to claim 1, wherein the number of the connection members is at least three, three of the connecting members, corresponding to three of the cap edges respectively are connected between the keycap and the frame body, and the pivoting portions correspondingly surround the outside of the sliding grooves.

15. The key structure according to claim 14, wherein the connecting member is aslant arranged between the keycap and the frame body, either end of any adjacent two sliding rods are kept close to each other and maintain a gap between them while either end of any adjacent two pivoting rods are away from each other.

16. The key structure according to claim 14, wherein the pivoting portion of the keycap comprises two pivoting bodies, two ends of the pivoting rod respectively pivot on the two pivoting bodies of the pivoting portion, and the two pivoting bodies of the pivoting portion are spaced apart from each other.

17. The key structure according to claim 14, wherein the frame body has a plurality of frame edges corresponding to the keycap, each frame edge forms an opening, each sliding groove is formed correspondingly to each frame edge, the sliding groove comprises a first sliding groove and a second sliding groove respectively formed on two ends of the position of the opening while two ends of the sliding rod are slidably limited in the first sliding groove and the second sliding groove, respectively.

18. The key structure according to claim 17, wherein the first sliding groove and the second sliding groove are spaced apart from each other, the first sliding groove and the second sliding groove of each of the adjacent two sliding grooves are arranged in a manner adjacent to each other.

* * * * *